US007884832B2

(12) United States Patent
Alessi et al.

(10) Patent No.: US 7,884,832 B2
(45) Date of Patent: Feb. 8, 2011

(54) CALIBRATING RGBW DISPLAYS

(75) Inventors: Paula J. Alessi, Rochester, NY (US); Christopher J. White, Avon, NY (US)

(73) Assignee: Global OLED Technology LLC, Herndon, VA (US)

( * ) Notice: Subject to any disclaimer, the term of this patent is extended or adjusted under 35 U.S.C. 154(b) by 795 days.

(21) Appl. No.: 11/734,934

(22) Filed: Apr. 13, 2007

(65) Prior Publication Data

US 2008/0252653 A1 Oct. 16, 2008

(51) Int. Cl.
*G09G 5/02* (2006.01)

(52) U.S. Cl. ..... 345/589; 345/207

(58) Field of Classification Search ..... 345/589, 345/207

See application file for complete search history.

(56) References Cited

U.S. PATENT DOCUMENTS

| | | | | |
|---|---|---|---|---|
| 6,611,249 | B1 | 8/2003 | Evanicky et al. | |
| 6,677,958 | B2 | 1/2004 | Cottone et al. | |
| 6,690,383 | B1 | 2/2004 | Braudaway et al. | |
| 2003/0048264 | A1 * | 3/2003 | Cottone et al. | 345/204 |
| 2004/0246274 | A1 | 12/2004 | Rykowski et al. | |
| 2005/0225561 | A1 | 10/2005 | Higgins et al. | |
| 2005/0275912 | A1 | 12/2005 | Chen et al. | |
| 2006/0012724 | A1 | 1/2006 | Park | |
| 2006/0215191 | A1 | 9/2006 | Tanase et al. | |
| 2006/0262053 | A1 * | 11/2006 | Lee et al. | 345/76 |

FOREIGN PATENT DOCUMENTS

| | | |
|---|---|---|
| EP | 1 681 668 | 7/2006 |

OTHER PUBLICATIONS

John W. Hamer et al; U.S. Appl. No. 11/734,899, filed Apr. 13, 2007; titled "Method for Input-Signal Transformation for RGBW Displays With Variable W Color".

* cited by examiner

*Primary Examiner*—Xiao M Wu
*Assistant Examiner*—Scott E Sonners
(74) *Attorney, Agent, or Firm*—Morgan, Lewis & Bockius LLP

(57) ABSTRACT

A method for calibrating a display device having four or more channels, including three main channels which include in their gamut a desired display white point, and one or more further channels, said display device also having one or more individual adjustment controls for each channel. The method uses a series of targets, which are each one or more activated display settings at which the luminance and chromaticity coordinates are measured and recorded.

21 Claims, 12 Drawing Sheets

CALIBRATING RGBW DISPLAYS

CROSS REFERENCE TO RELATED APPLICATIONS

Reference is made to commonly-assigned, copending U.S. Ser. No. 11/734,899 filed concurrently herewith entitled "Method for Input-Signal Transformation for RGBW Displays With Variable W Color" by Hamer et al, the disclosure of which is incorporated herein by reference.

FIELD OF THE INVENTION

The present invention relates to calibrating flat-panel displays, and in particular to a method for calibrating color displays including at least one within-gamut emitter.

BACKGROUND OF THE INVENTION

In today's digital infoimaging world, many images are previewed and manipulated on electronic flat panel displays. New display applications (i.e. cell phones, DVD, palm pilots, video games, GPS, TV, etc.) impose greater design requirements and improved imaging performance than other imaging display devices used previously. Displays are intended to provide a realistic representation of the images to the viewer, thus there is a need to correct display color and tonal responses to enhance the display image quality. The color and tonal enhancement must be implemented in the display's imaging chain.

Flat panel displays such as OLED displays have the potential for providing superior performance in brightness and color resolution, wide viewing angle, low power consumption, and compact and robust physical characteristics. However, unlike CRTs, these flat panel displays have a fixed white point and a chromatic neutral response that result from the manufacturing process, and are not adjustable. Variations in the manufacturing process result in variations in the white point and chromatic neutral, and therefore unwanted variations in display color reproduction. With manufacturing processing variability and the need to increase yield to reduce costs, it becomes imperative to develop robust and easily implemented color characterization and display driving techniques that accommodate manufacturing variations.

In a common OLED color display device, a pixel includes red, green, and blue colored OLEDs. These OLEDs correspond to color primaries that define a color gamut. By additively combining the illumination from each of these three OLEDs, i.e. with the integrative capabilities of the human visual system, a wide variety of colors can be achieved. OLEDs can be used to generate color directly using organic materials that are doped to emit energy in desired portions of the electromagnetic spectrum, or alternatively, broadband emitting (apparently white) OLEDs can be attenuated with color filters to achieve red, green and blue. It is possible to employ a white, or nearly white, OLED along with the red, green, and blue OLEDs to improve power efficiency and/or luminance stability over time.

Various methods of calibrating flat-panel displays have been proposed. For example, Cottone et al., in U.S. Pat. No. 6,677,958, disclose a method of calibrating a color flat panel display. Chiu et al., in US 2006/0038748, teach an image processing method for a plasma display panel. Evanicky et al., in U.S. Pat. No. 6,611,249, disclose a method of calibrating an LCD display with two different white light sources. Rykowski et al., in US 2004/0246274, provide a method for calibrating a display, including a light-emitting-diode display. Yasuda et al., in EP 1 681 668, describe a calibration method for a display, and in particular for an LCD display. Shimonishi, in US 2006/0044234, teaches a method of calibrating and adjusting a self-emissive display, e.g. an OLED or plasma display. Park, in US 2006/0012724, teaches a method of calibrating a flat panel display to produce color similar to a CRT display. Braudaway et al., in U.S. Pat. No. 6,690,383, teach a method of calibrating a display whose properties differ from a CRT display. However, all these methods only concern three gamut-defining emitters, e.g. red, green, and blue, and do not include a within-gamut emitter, such as white.

There is a need therefore for an improved method of calibrating and driving flat-panel displays that include within-gamut emitters.

SUMMARY OF THE INVENTION

In accordance with one embodiment, the invention is directed towards a method for calibrating a display device having four or more channels, including three main channels which include in their gamut a desired display white point, and one or more further channels, said display device also having one or more individual adjustment controls for each channel, said method comprising the steps of:

a) displaying a first target using a low level code value for each channel of the display;

b) measuring and recording the luminance and chromaticity coordinates of the displayed first target;

c) displaying a second target using a minimum code value for each of the further channels, and a set of non-minimum code values, such set including one non-minimum code value for each of the three main channels;

d) measuring the luminance and chromaticity coordinates of the displayed second target;

e) adjusting the individual adjustment controls for each of the three main channels so that the chromaticity coordinates of the second target approximately match the chromaticity coordinates of the desired display white point;

f) recording the resulting values of the individual adjustment controls for each of the three main channels and the corresponding luminance and chromaticity coordinate measurements;

g) repeating steps c) through f) one or more times for each of a number of additional selected non-minimum code value sets;

h) displaying a third target using, for a first main channel, the value(s) of the individual adjustment control(s) for that channel recorded in step f) corresponding to a selected non-minimum code value set, and using, for each of the other channels, a minimum code value;

i) measuring and recording the luminance and chromaticity coordinates of the displayed third target;

j) repeating steps h) through i) for each remaining main channel;

k) displaying a fourth target using a selected code value for a first further channel, and a minimum code value for each of the other channels;

l) measuring and recording the luminance and chromaticity coordinates of the displayed fourth target;

m) repeating steps k) through l) for one or more of a number of additional selected code values of the first further channel; and n) repeating steps k) through m) for each remaining further channel.

ADVANTAGES

It is an advantage of this invention that it performs a calibration for a display device having four or more channels resulting in an achromatic neutral scale that is more representative of real operating conditions than prior art methods. It is a further advantage of this invention that it leads to a simpler calibration method, as it does not require measuring individual red, green, and blue main channel scales, and thus requires fewer steps than prior art methods. It is a further advantage that no additional computation is required to get an achromatic neutral scale. It is a further advantage that the calibration method of the invention can be easily automated. It is a further advantage of this invention that it reduces error due to additivity failure to a greater extent than other methods.

DETAILED DESCRIPTION OF THE INVENTION

Figure 1:
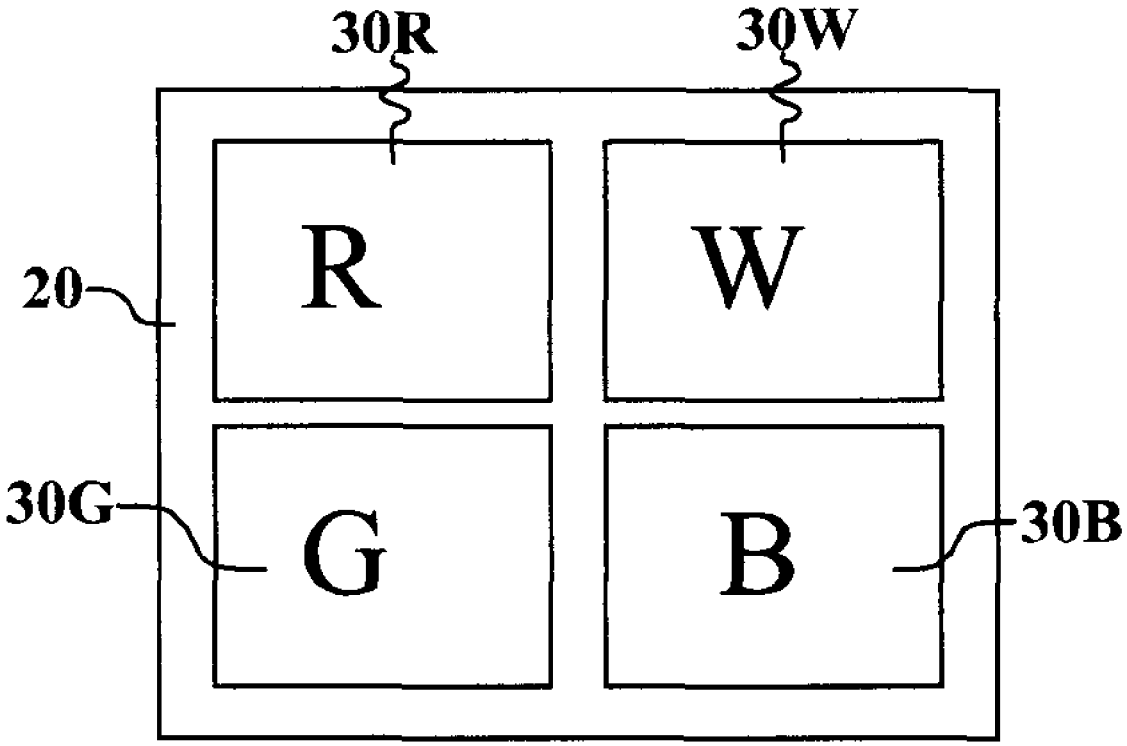
FIG. 1 is a plan view of one embodiment of an OLED device with main and further channels that can be used in the method of this invention.

Turning now to FIG. 1, there is shown a plan view of one embodiment of a display device such as an OLED device with main and further channels that can be used in the method of this invention. The display device includes one or more pixels 20, each of which comprises at least four light-emitting elements, which correspond to an equivalent number of channels or primaries. Three of the channels are main or gamut-defining channels, that is, the light-emitting elements emit light that determines the range of colors that the display can produce, and are commonly red (R) channel 30R, green (G) channel 30G, and blue (B) channel 30B. The display device also has one or more further channels, e.g. 30W, which can have color that varies with code value. In OLED systems, this color variation with code value occurs commonly in further channels that are broadband emitters, that is elements that emit light in a wide range of wavelengths and wherein the color is within the gamut formed by the main channels. It is most commonly a problem in white emitters, but this invention is not limited to that case. Further included within the gamut formed by the main channels is a desired display white point, which is the color considered to be white emission, e.g. having chromaticity coordinates corresponding to CIE Standard Illuminant D65. The display device also has individual adjustment controls for each channel, which will be described more fully below.

A display calibration procedure typically starts with establishment of the desired display white and black points. The desired display white point is established in terms of x, y, and Y, where x and y are 1931 CIE chromaticity coordinates and Y is the 1931 CIE luminance in units of cd/m$^2$. The chromaticity coordinates of the desired display white point will also be referred to herein as a neutral, which can include lower luminance points, e.g. gray and black. The desired display black point is established in terms of the 1931 CIE luminance in units of cd/m$^2$. Ideally, the desired display black point has the same chromaticity coordinates as the desired display white point, but the black luminance level is often so low that it can be difficult to achieve the same chromaticity coordinates as the desired display white point. There is also a peak display white point, which is herein defined as the maximum possible luminance at the desired chromaticity coordinates. Depending on the application, the desired display white point and the peak display white point can be the same or different. For example, one may choose to set the desired display white point at a lower luminance than the peak display white point to leave some headroom for display luminance or chromaticity coordinate changes over time. It is also important to define the peak display luminance point as the point at which all main channels are driven to their maximum level. This peak display luminance point may not be at the same chromaticity coordinates as the desired display white point or the peak display white point.

Figure 2:
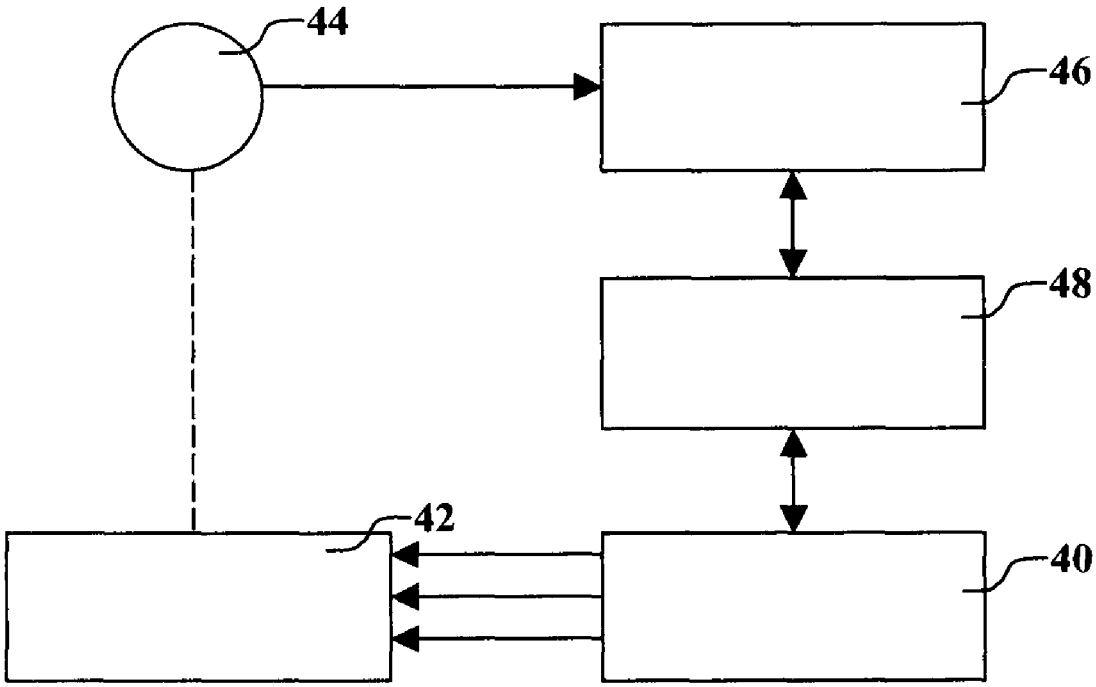
FIG. 2 is a schematic diagram showing one embodiment of a color imaging system that can used in the practice of this invention.

The typical color imaging system including the hardware necessary to calibrate the display, as illustrated in FIG. 2, includes a computer 40, which is connected to a color display 42 such as an OLED display. Display 42 is monitored by a sensor 44, e.g. a photodiode. Sensor 44 is connected to a light meter 46. Light meter 46 can be a spectroradiometer to give spectral data and computed luminance and chromaticity coordinate information, or a colorimeter to give the luminance and chromaticity coordinate information directly. An analog/digital converter 48 converts the light intensity detected by sensor 44 and measured by light meter 46 into a digital signal to computer 40. It is important that sensor 44 be responsive to the portions of the spectrum where the display emits light, that is the sensor must be able to sense a light difference between e.g. a 0,0,0 display code value and a 0,0,1 display code value. As a consequence, it is also necessary that the sensor and meter have a higher resolution than the display being measured. If the display code values are 8 bit codes, it is recommended that the resolution of the sensor and meter be no less than 12 bits and preferably 16. The sensor must also have adequate sensitivity to accurately characterize the display lowlights. Light meter 46 must also have an integration time sufficient to obtain a low noise light output intensity reading. Light meter 46 should also periodically be calibrated to a known light source of an appropriate calibration laboratory. A filter (not shown) can be used to flatten out the response curve of the sensor 44. In the method described herein, it will be understood that activating a selected channel (e.g. the red channel) means activating all the pixels of a given channel—or a selected portion thereof—within the area detected by sensor 44.

Figure 3:
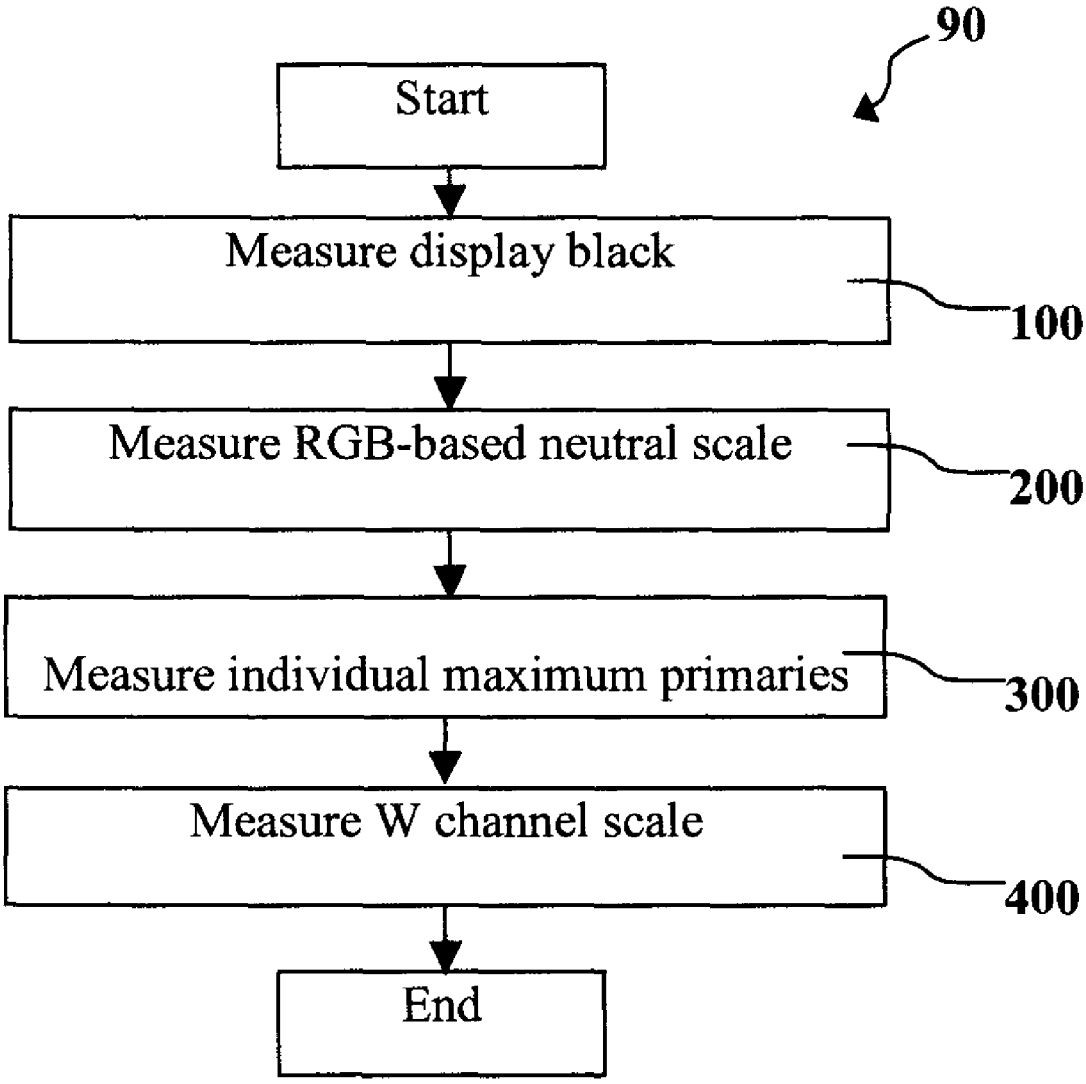
FIG. 3 is a block diagram of one embodiment of the basic method of this invention.

Turning now to FIG. 3, there is shown a block diagram of one embodiment of the basic method of this invention for calibrating a display device, e.g. the OLED display of FIG. 1. The method uses a series of targets, which are each one or more activated display settings at which the luminance and chromaticity coordinates are measured and recorded. At the start of the method, a first target is displayed using a low level code value for each channel (e.g. R,G,B and W) of the display, which will typically correspond to the desired display black point, and luminance and chromaticity coordinates are measured (Step 100). Then a second target is displayed using a minimum code value for the W channel (the further channel) and a series of sets of non-minimum code values for the R, G, and B channels (the main channels) with adjustment to provide the chromaticity coordinates for a neutral scale based on the main channels. The display luminance and chromaticity coordinates are measured for each set in the series (Step 200). This step will also provide a peak display white point. Then a third target is displayed using, for each of the main channels individually, code values from one of the neutral scale measurements of Step 200 while the code values for all other channels is at a minimum. The display luminance and chromaticity coordinates are measured for each channel (Step 300). Then a fourth target is displayed using minimum values for the main channels and a series of non-minimum code values for the W or further channel. The display luminance and chromaticity coordinates are measured for the series (Step 400). It will be understood by those skilled in the art that the order of the steps in FIG. 3 can be changed, except that Step 200 must precede Step 300. Further details of each of the above steps will be described below.

Figure 4:
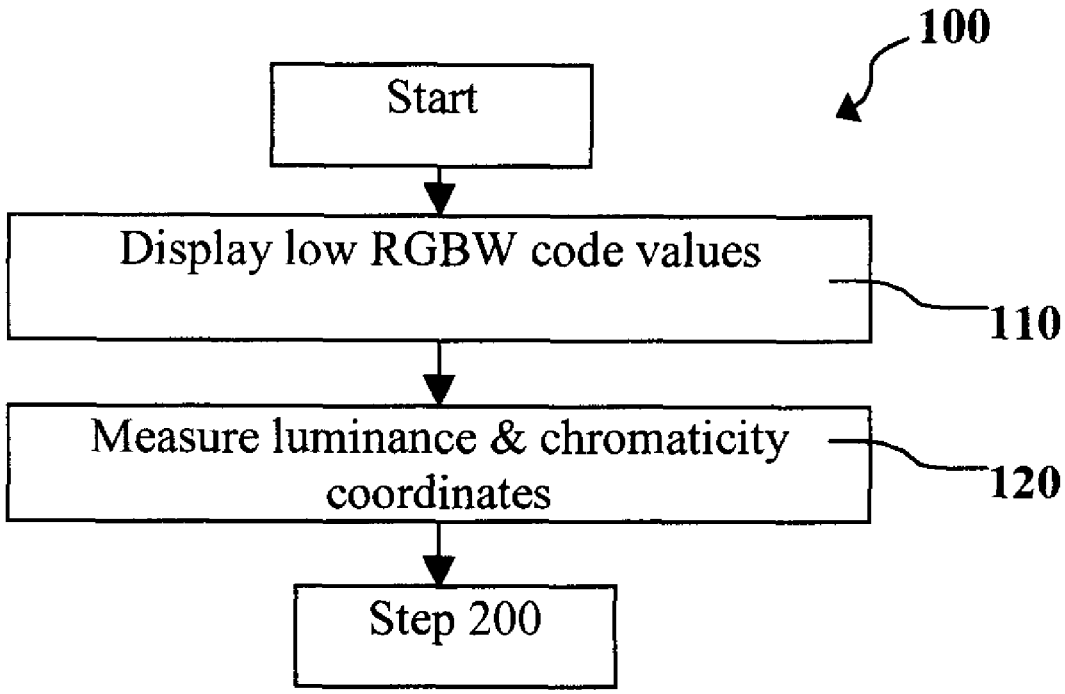
FIG. 4 is a block diagram showing the first step of FIG. 3 in greater detail.

Turning now to FIG. 4, there is shown Step 100 of FIG. 3 in greater detail. Initially, the first target is displayed, which means using a low level code value for each channel of the display, e.g. the R, G, B, and W channels of FIG. 1 (Step 110). The low level code values are typically zero, but can be a non-zero code value for one or more of the channels that provides the desired display black point. It can be desirable for some displays to select a non-zero code value for the desired display black point to leave some headroom for display luminance changes over time. The luminance and chromaticity coordinates of the displayed first target are then measured and recorded, e.g. by the apparatus of FIG. 2 (Step 120).

Figure 5:
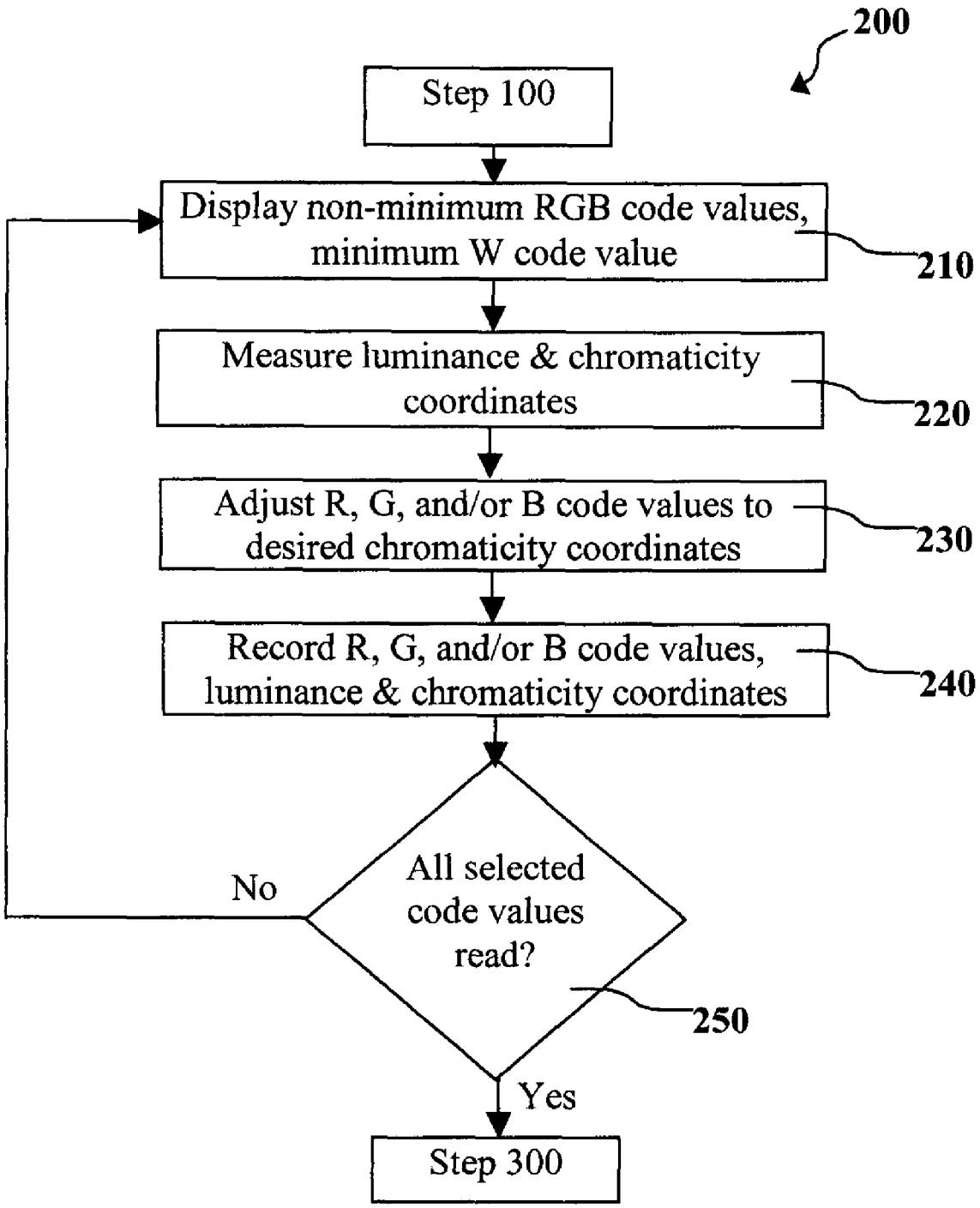
FIG. 5 is a block diagram showing the second step of FIG. 3 in greater detail.

Turning now to FIG. 5, there is shown Step 200 of FIG. 3 in greater detail. Initially, the second target is displayed, which means that the display is activated using a minimum code value for any further channel (the W channel, in this embodiment) and a set of non-minimum code values for the main channels. The set includes one non-minimum code value for each of the main channels (the R, G, and B channels in this embodiment) (Step 210). The minimum code value for any channel is selected to provide luminance at most negligibly greater than the luminance of that channel driven with the low level code value for that channel used in displaying the first target, and is typically zero. The luminance and chromaticity coordinates of the displayed second target are then measured (Step 220). Ideally, the chromaticity coordinates measured will be those of a neutral, e.g. a gray or white matching the chromaticity coordinates of the desired display white point; in reality, this is not necessarily the case. Thus, it can be necessary to adjust one or more individual adjustment controls of the R, G, and B channels to match the desired display white point chromaticity coordinates as closely as possible (Step 230). One convenient embodiment is to use the code value for a channel as the individual adjustment control. For example, an initial set of non-minimum code values might be R=10, G=10, and B=10. However, after measuring the luminance and chromaticity coordinates of the display, it may be found that the code values must be adjusted to e.g. R=9, G=10, and B=12 to most closely match the chromaticity coordinates of the display white point. Thus the values of the individual adjustment controls would be R=−1, G=0, and B=+2. The luminance and chromaticity coordinates produced by the display are measured using the adjusted code values, and are recorded along with the corresponding values of the individual adjustment controls for each of the three main channels (Step 240). If there are more sets of code values to be displayed as part of the second target (Step 250), Steps 210 to 240 are repeated for each additional desired set of non-minimum code values. The highest luminance set of code values possible for this target will be that for the peak display white point, which will be the set that produces the chromaticity coordinates of the desired display white point and wherein at least one of the main channel code values is at its maximum value. For example, a neutral produced in an 8-bit code-value system by R=196, G=183, and B=255 will be the peak display white point because the B channel is at its maximum. An example for one display of such a series of sets of code values is shown in Table 1. The aim code value is the initial code value selected for all three channels in a given set, while the adjusted code values are those obtained after doing the adjustment described above. The chromaticity coordinates and luminances were those measured with the adjusted code values.

TABLE 1

| Aim Code | Selected Code Value Sets | | | Chromaticity Coordinates | | Luminance |
|---|---|---|---|---|---|---|
| Value | R | G | B | x | y | Y (cd/m$^2$) |
| 0 | 0 | 0 | 0 | 0.4601 | 0.3928 | 0.05 |
| 10 | 5 | 5 | 10 | 0.4238 | 0.4020 | 0.07 |
| 20 | 9 | 9 | 20 | 0.3358 | 0.3519 | 0.14 |
| 30 | 20 | 18 | 30 | 0.3157 | 0.3358 | 0.69 |
| 40 | 26 | 24 | 40 | 0.3116 | 0.3330 | 2.18 |
| 50 | 32 | 30 | 50 | 0.3091 | 0.3319 | 5.60 |
| 65 | 45 | 42 | 65 | 0.3110 | 0.3299 | 15.90 |
| 80 | 50 | 46 | 80 | 0.3096 | 0.3258 | 23.64 |
| 95 | 57 | 53 | 95 | 0.3116 | 0.3294 | 36.49 |
| 115 | 67 | 60 | 115 | 0.3124 | 0.3279 | 54.75 |
| 135 | 85 | 74 | 135 | 0.3128 | 0.3292 | 81.89 |
| 155 | 106 | 93 | 155 | 0.3123 | 0.3301 | 123.35 |
| 175 | 130 | 114 | 175 | 0.3128 | 0.3289 | 170.88 |
| 200 | 155 | 140 | 200 | 0.3133 | 0.3283 | 252.52 |
| 225 | 176 | 162 | 225 | 0.3124 | 0.3284 | 363.18 |
| 245 | 188 | 175 | 245 | 0.3132 | 0.3284 | 443.70 |
| 255 | 196 | 183 | 255 | 0.3126 | 0.3279 | 488.07 |

It will be understood that other adjustment controls can also be used for the adjustment in Step 230, for example gamma voltages as taught by Park et al. in U.S. Pat. No. 6,806,853, analog gains and/or offsets as taught by Cottone et al. in U.S. Pat. No. 6,677,958, and linear processing methods, such as digital gain and offset, as described in "A Technical Introduction to Digital Video" by C. Poynton, John Wiley & Sons, New York, 1996, chapters 5 & 6. However, code values are a convenient adjustment because they can also be used to set the display's channel luminances and chromaticity coordinates, so that the adjustment can be done by the same apparatus (e.g. computer 40 in FIG. 2), and thus this method can easily be automated.

Figure 6:
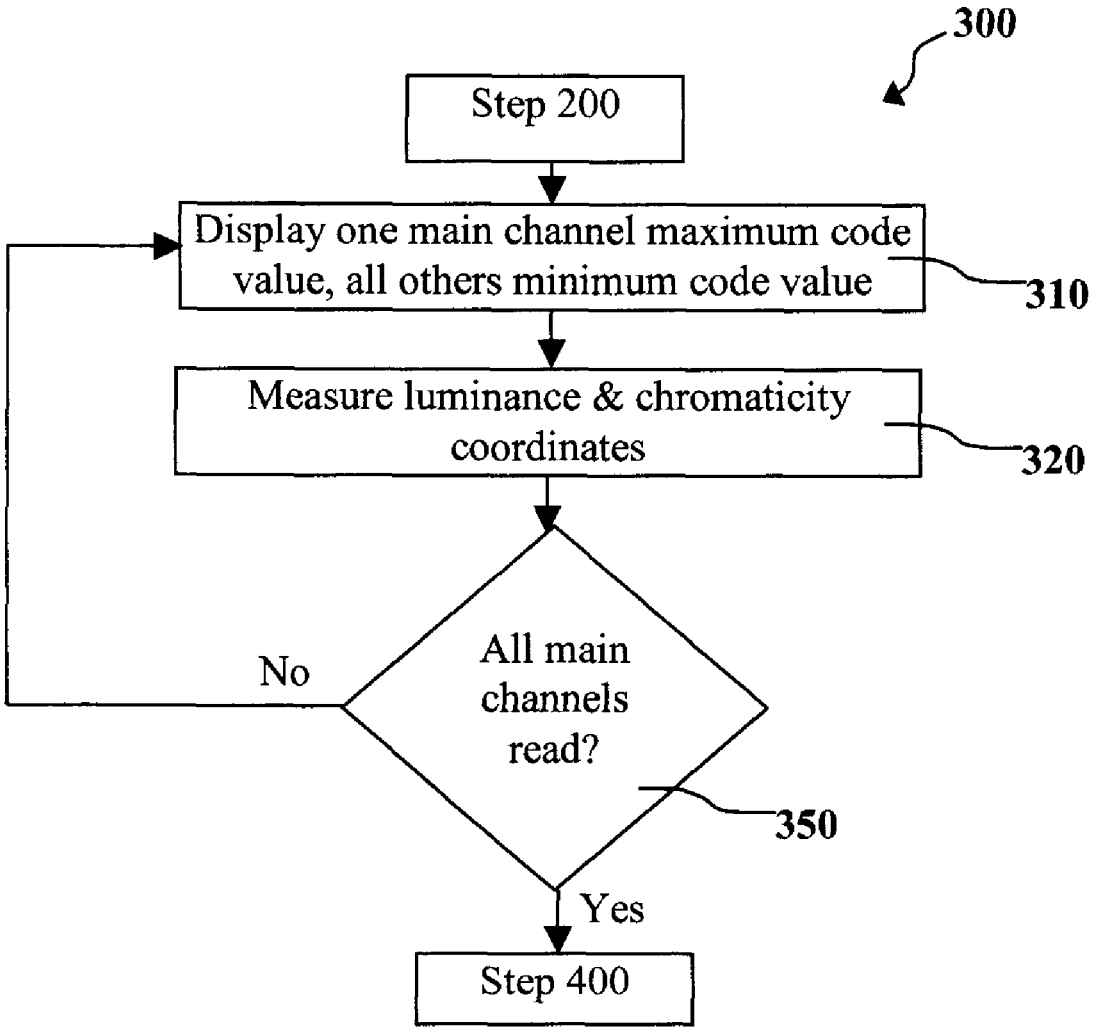
FIG. 6 is a block diagram showing the third step of FIG. 3 in greater detail.

Turning now to FIG. 6, there is shown Step 300 of FIG. 3 in greater detail. Initially, a set of non-minimum code values is selected from the sets used in Step 210 of FIG. 5. The third target is displayed, which means that one of the main channels of the display is activated using the non-minimum code value and the corresponding value(s) of the individual adjustment controls(s) for that channel. The non-minimum code value can be that used to produce the desired display white point, the peak display white point, or another neutral point (e.g. from Table 1). A minimum code value is used for each of the other main channels and the further channels (Step 310). The minimum code value is desirably, but not necessarily, zero. In the example above where the highest luminance neutral is produced by R=196, G=183, and B=255, the code value can be 255 and the individual adjustment controls would then be R=−59, G=−72, and B=0. For the red channel, a code value of 255−59=196 would be used. The luminance and chromaticity coordinates of the displayed third target are measured and recorded (Step 320). This process is repeated (Step 350) for each of the remaining main channels, e.g. green and blue. It is desirable that the same non-minimum code value set is selected for each main channel. An example for the display of Table 1 is shown in Table 2. The non-minimum code value used for each main channel is that of the peak display white point, that is, the values represented by aim code value 255 in Table 1, while the minimum code values are zero. The chromaticity coordinates and luminances were those measured at the code values shown.

TABLE 2

| Selected Non-Minimum Code Value Sets | | | Chromaticity Coordinates | | Luminance |
|---|---|---|---|---|---|
| R | G | B | x | y | Y (cd/m$^2$) |
| 196 | 0 | 0 | 0.6298 | 0.363 | 139.14 |
| 0 | 183 | 0 | 0.2906 | 0.6069 | 249.41 |
| 0 | 0 | 255 | 0.1479 | 0.1339 | 99.37 |

An advantage of selecting the set of non-minimum code values corresponding to the peak display white point from Step 240 of FIG. 5 is that the largest color gamut will be produced. However, one could use a different set with relatively high code values without a large deterioration in calibration quality because the chromaticity coordinates of each main channel do not show large variations at high code values.

Figure 7:
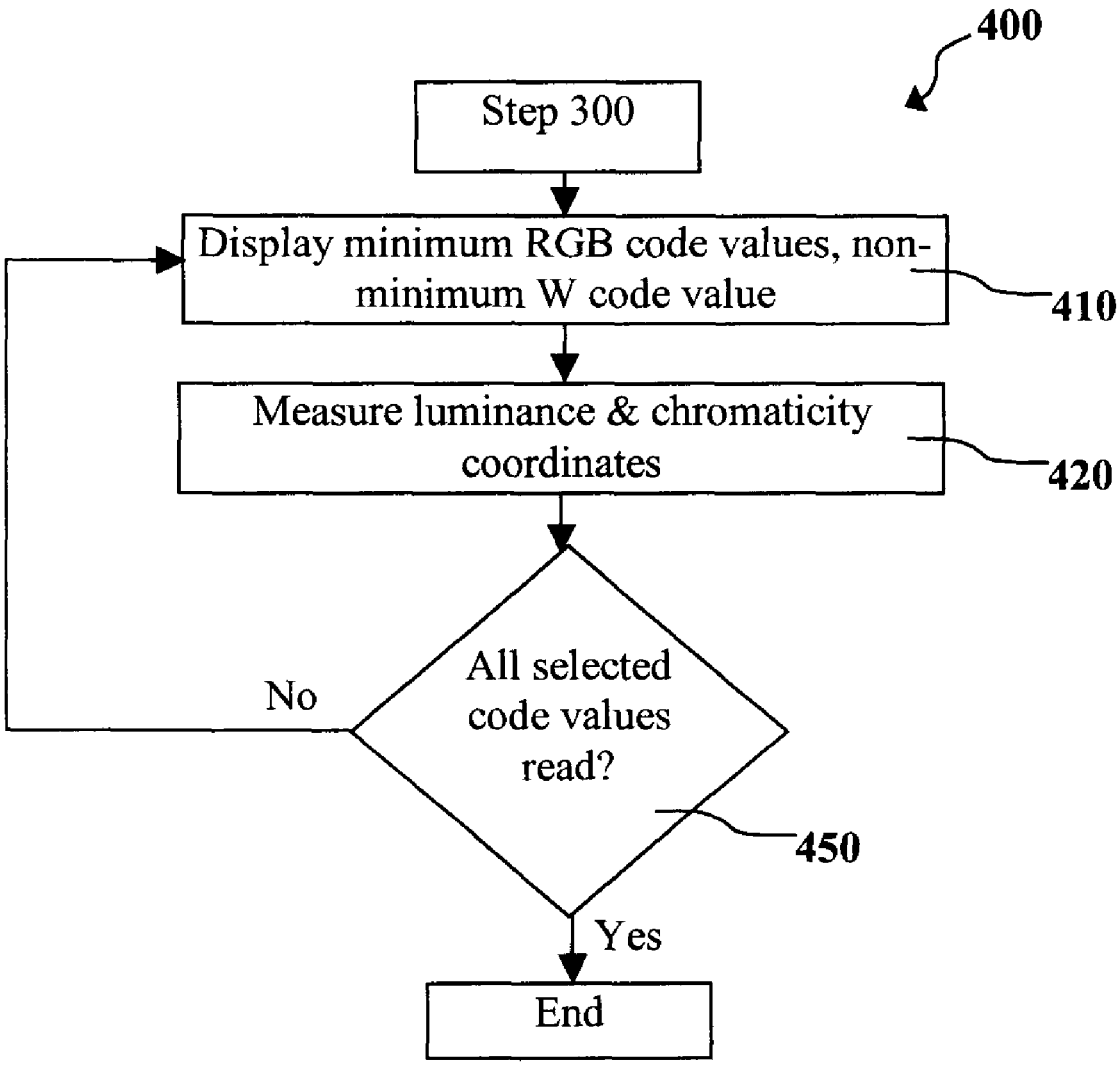
FIG. 7 is a block diagram showing the fourth step of FIG. 3 in greater detail.

Turning now to FIG. 7, there is shown Step 400 of FIG. 3 in greater detail. Initially, the fourth target is displayed, which means that the display is activated using a selected code value for a further channel (the W channel in this embodiment) and a minimum code value for each of the other channels (Step 410). In this embodiment, the other channels are the main (R, G, and B) channels. In other embodiments that include additional further channels, those additional further channels would also have a minimum code value at this step. The minimum code values are desirably, but not necessarily, zero. The luminance and chromaticity coordinates of the displayed fourth target are then measured (Step 420). If there are additional code values to be displayed as part of the fourth target (Step 450), Steps 410 to 420 are repeated for each additional selected code value of the further channel. In embodiments with additional further channels, Steps 410 to 450 can be repeated for each remaining further channel. An example for the display of Tables 1 and 2 is shown in Table 3. The chromaticity coordinates and luminances were those measured at the code values shown for the W channel.

TABLE 3

| Code Value for Further Channel | Chromaticity Coordinates | | Luminance |
|---|---|---|---|
| W | x | y | Y (cd/m$^2$) |
| 0 | 0.4601 | 0.3928 | 0.05 |
| 10 | 0.4284 | 0.4076 | 0.10 |
| 20 | 0.3909 | 0.4136 | 0.63 |
| 30 | 0.3677 | 0.4065 | 4.43 |
| 40 | 0.3556 | 0.3973 | 12.78 |
| 50 | 0.3454 | 0.3890 | 27.41 |
| 65 | 0.3360 | 0.3787 | 62.63 |
| 80 | 0.3320 | 0.3751 | 85.69 |
| 95 | 0.3295 | 0.3710 | 119.23 |
| 115 | 0.3267 | 0.3674 | 163.09 |
| 135 | 0.3247 | 0.3643 | 221.34 |
| 155 | 0.3241 | 0.3611 | 299.11 |
| 175 | 0.3241 | 0.3586 | 398.82 |
| 200 | 0.3248 | 0.3560 | 557.45 |
| 225 | 0.3258 | 0.3539 | 748.55 |
| 245 | 0.3261 | 0.3527 | 889.46 |
| 255 | 0.3262 | 0.3521 | 971.34 |

Figure 8:
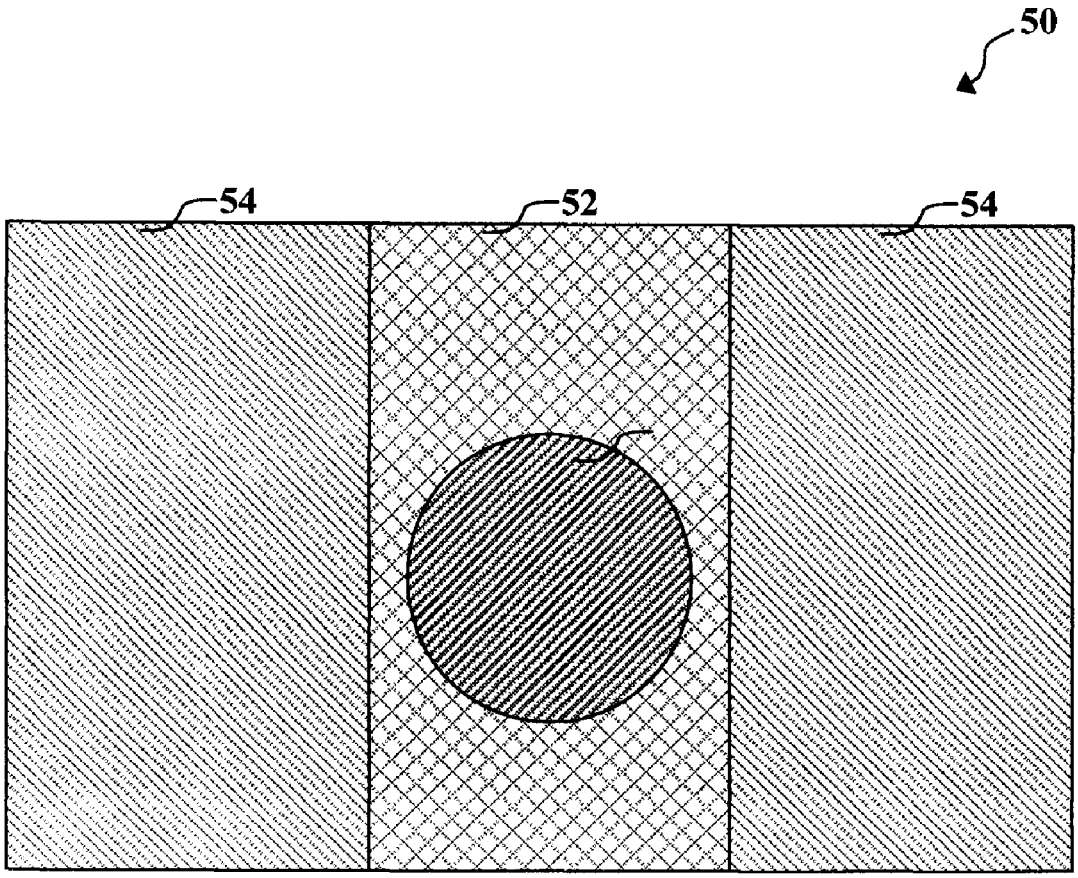
FIG. 8 shows a display demonstrating one method of driving the display to maintain a constant current.

In measurements of this type, it can be a problem to make the display luminance directly proportional to the current at all levels, for several reasons. One reason is that the display's peripheral circuitry has a resistance. At a high display luminance, which requires a high display load for the current, the voltage loss through the peripheral circuitry will be greater than at low luminance/low load, changing the voltage across the displayed pixels and introducing non-linearity into the luminance-current response of the display. It is desirable to maintain a constant display load to minimize this effect. It can also be desirable that the constant display load approximately matches a display reference load condition, e.g. the average display load over the lifetime of the display. Since the world integrates to an 18% gray (van der Weijer, J. and Gevers, T., "Color Constancy Based on Grey-Edge Hypothesis", IEEE International Conference on Image Processing, ICIP, 2005), this can be used to represent the average display luminance over the lifetime of the display. Turning now to FIG. 8, there is shown a display demonstrating one method of driving the display to maintain a constant display load by displaying a boost pattern or a reduction pattern. In display 50, measurement area 56 corresponds to the area measured by the detector, e.g. sensor 44 of FIG. 2. The target area 52 of display 50 is the area comprising a flat field driven with selected code values to be displayed, e.g. first target, second target, etc. It is at least as large as measurement area 56. Additional pixels outside target area 52, e.g. non-measurement area 54, are driven with lower or higher code values to maintain a constant display load across display 50 as a whole. When target area 52 is a relatively low luminance target, that is driven with low code values, additional pixels of non-measurement area 54 can be driven with higher code values, which is herein termed a boost pattern, to increase the display load so that the display load approximately matches the display reference load condition. When target area 52 is a relatively high luminance target, that is driven with high code values, additional pixels of non-measurement area 54 can be driven with lower code values, which is herein termed a reduction pattern, to decrease the display load so that the display load approximately matches the display reference load condition.

Figure 9:
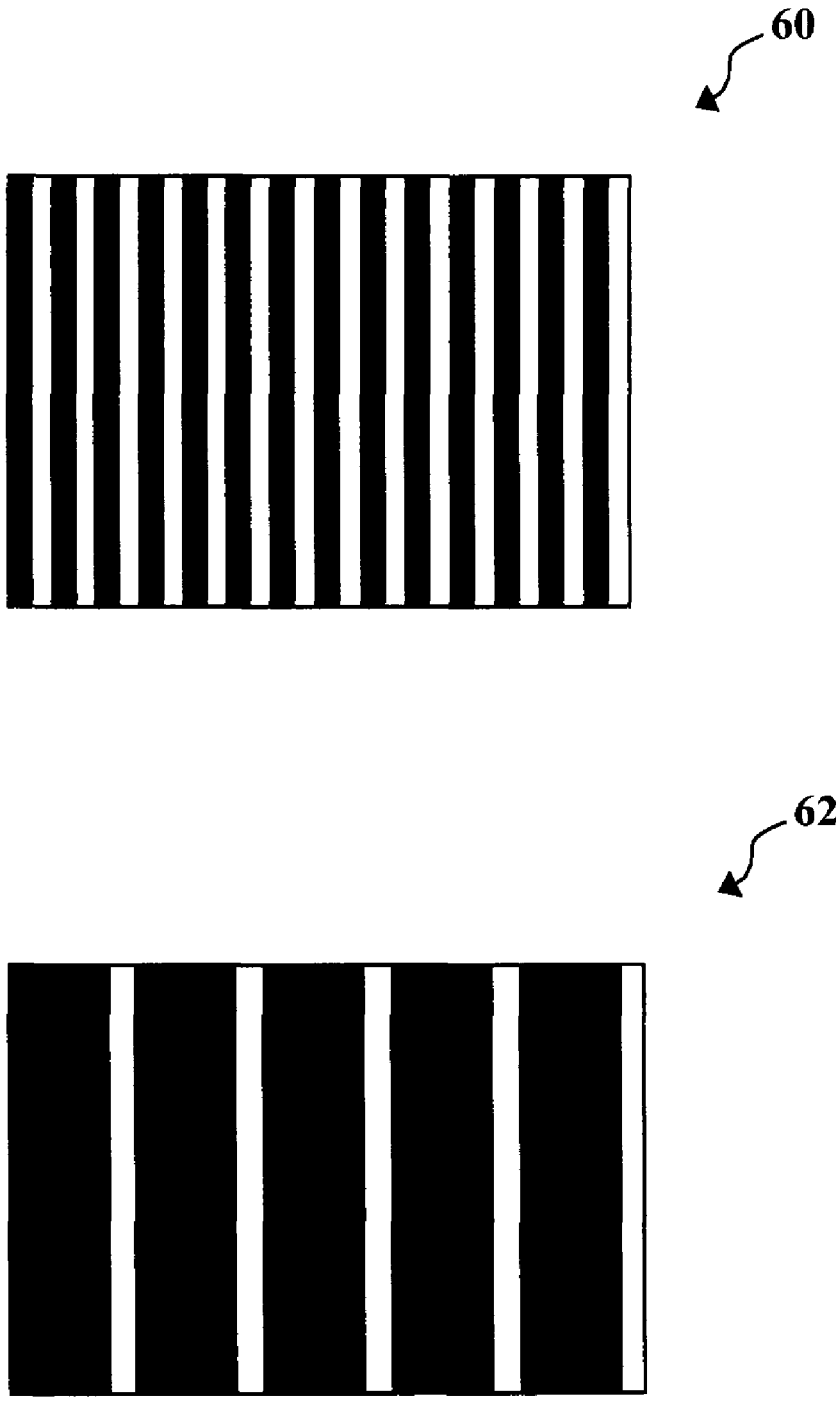
FIG. 9 shows examples of buck patterns that can be used in the practice of this invention.

An alternative method of maintaining a display load approximately matching a display reference load condition at relatively high luminance is by displaying one or more buck patterns on the display, as shown in FIG. 9. In a buck pattern, some pixels are driven with selected code values (light bars)

across a target, while other pixels are driven with relatively lower code values (dark bars). The relatively lower code values can be zero, but are not limited to that. In buck pattern 60, half of the pixels—every other column—can be driven at the higher code value. In buck pattern 62, one-fifth of the pixels can be driven at the higher code value. If the display reference is 18% gray, an appropriate portion of the pixels can be displayed at the selected code value, while the remainder of the pixels are driven with relatively lower code values, which can be zero or nearly zero. The luminance measured by the sensor can be multiplied by an appropriate factor to determine the true total luminance of the display at the given code value.

These patterns can be used together. For example, for a target at a relatively low luminance, a boost pattern can be displayed on the display to increase the display load. For a different target at a relatively high luminance, a reduction pattern or a buck pattern can be displayed on the display to decrease the display load. Thus, for different targets at different relative luminances, the display load can be made to approximately match the display reference load condition.

While a display load approximately matching the display reference load condition can also be achieved with a flat field reduction pattern as described above, a buck pattern has the additional advantage of being able to maintain the display reference load condition across the entire display. A reduction pattern of FIG. 8 can cause portions of display 50, such as target area 52, to be hotter than others, such as non-measurement area 54, and hotter than the temperature expected under the display reference load condition. The temperature expected under the display reference load condition is called herein the display reference temperature. The display reference temperature can be measured by driving a display at the selected display reference load condition for a time sufficient to allow the temperature to equilibrate, and measuring the display temperature, e.g. by a thermocouple attached to the display surface at the measured area or as close as would be possible to it without interfering with any luminance and colorimetric measurements. The temperature of the display can affect the luminance, which can lead to measurement errors. By the use of boost patterns, reduction patterns, and buck patterns, all the targets can be displayed on the display in a manner so as to approximately match the display reference temperature. Alternatively, one can adjust the temperature of the display by a variety of methods, e.g. self-heating by displaying a bright pattern before displaying the target, ventilation of the display to cool it, or a thermoelectric heating and cooling unit attached to the display.

The measured data and individual adjustment control values for each channel obtained from the method described herein can be used to compute values used by an image processing path to drive the display device. Such a method of computing values used by an image processing path has been described, e.g., by Giorgianni and Madden in *Digital Color Management: encoding solutions*, Reading: Addison-Wesley, 1998.

Figure 10:
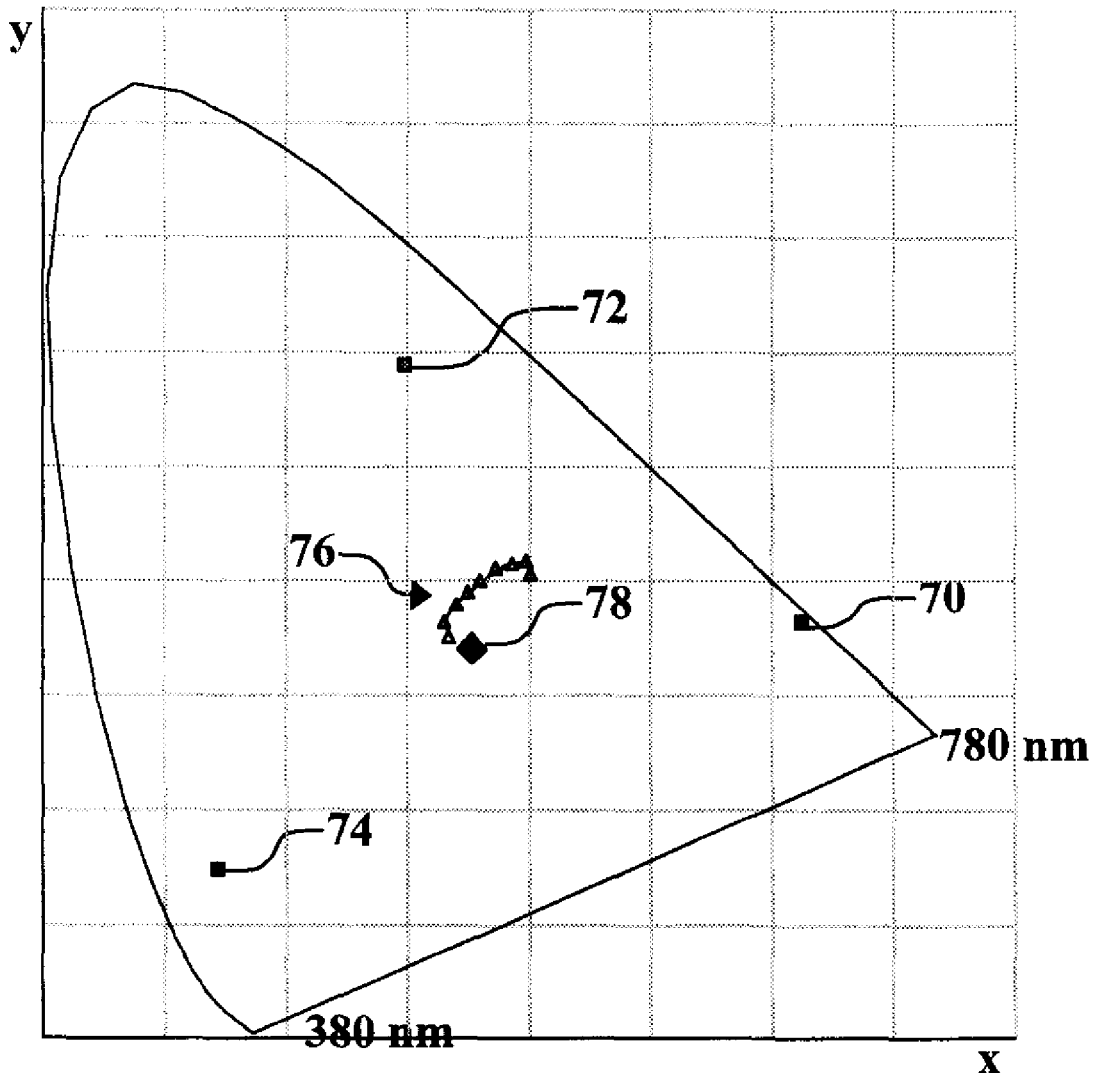
FIG. 10 shows a 1931 CIE chromaticity diagram showing the emission results for an OLED device of FIG. 1 where a further channel has color that varies with code value.

Turning now to FIG. 10, there is shown a 1931 CIE chromaticity diagram showing the emission result for four emitters. These emitters include three main or gamut-defining channels (red channel 70, green channel 72, and blue channel 74), and a further channel (W, 76) that has chromaticity coordinates that vary with code value, and therefore with the luminance level, and that is within the gamut formed by the red, green, and blue channels. The main channels also include in their gamut a desired display white point 78. As shown, data for the W channel was collected at a series of code values as shown in FIG. 7. For each code value, the chromaticity coordinates (x,y) and luminance (Y) are measured using a colorimeter. These values can be transformed to XYZ tristimulus values according to calculations outlined in "Colorimetry", CIE Publication 15:2004 3$^{rd}$ edition published by the CIE Central Bureau in Vienna, Austria. The XYZ tristimulus values can be used in Eq. 1) to generate red, green, and blue intensities ($R_i$, $G_i$, and $B_i$) that produce equivalent color to the further channel over a range of code values used.

$$\begin{pmatrix} X_R & X_G & X_B \\ Y_R & Y_G & Y_B \\ Z_R & Z_G & Z_B \end{pmatrix}^{-1} \begin{pmatrix} X \\ Y \\ Z \end{pmatrix} = \begin{pmatrix} R_i \\ G_i \\ B_i \end{pmatrix} \qquad \text{Eq. 1)}$$

The relationship given in Eq. 1) was derived by W. T. Hartmann and T. E. Madden, "Prediction of display colorimetry from digital video signals", J. Imaging Tech, 13, 103-108, 1987. The 3×3 matrix is known as the inverse primary matrix, where the columns of the matrix $X_R$, $Y_R$, and $Z_R$ are the tristimulus values for the red gamut-defining primary, $X_G$, $Y_G$, and $Z_G$ are the tristimulus values for the green gamut-defining primary, and $X_B$, $Y_B$, and $Z_B$ are the tristimulus values for the blue gamut-defining primary. Colorimetric measurements resulting in XYZ tristimulus values of each gamut-defining channel were the data collected in FIG. 6. The intensities of the further channel at each level can be plotted to determine the relationship between the code value of the further channel and intensities of the three main channels. Determination of this relationship is further described in Hamer et al. copending, commonly assigned U.S. Ser. No. 11/734,899 filed concurrently herewith, the disclosure of which is incorporated herein by reference.

Once determined, the relationship between code value of the further channel and intensities of the three main channels can be employed to transform the common three color-input signals (e.g. R, G, and B) corresponding to the three main channels of the display to four color-output signals, corresponding to the main channels and the further channel of the display, which can be labeled R', G', B', and W. Typically, one starts with a desired color specified as three color-input signals wherein each of the three components is linear with respect to intensity for red, green, and blue, and corresponds to the main channels of the display. If the color-input signals are non-linear with respect to intensity, they can first be converted to a linear signal, for example by a conversion such as sRGB (IEC 61966-2-1:1999, Sec. 5.2). The relationship can be employed with the three color-input signals (R, G, B) to determine a drive value W (which can be a code value) of the four color-output signals and modification values to be applied to one or more of the R, G, B components of the three color-input signals to form the R', G', B' color-output signals, as further described in Hamer et al. U.S. Ser. No. 11/734,899. The display can then be driven with the four color-output signals, or transformed values thereof (e.g. the R', G', and B' components of the four color-output signals, which are linear in intensity, can be transformed into display code values).

Figure 12:
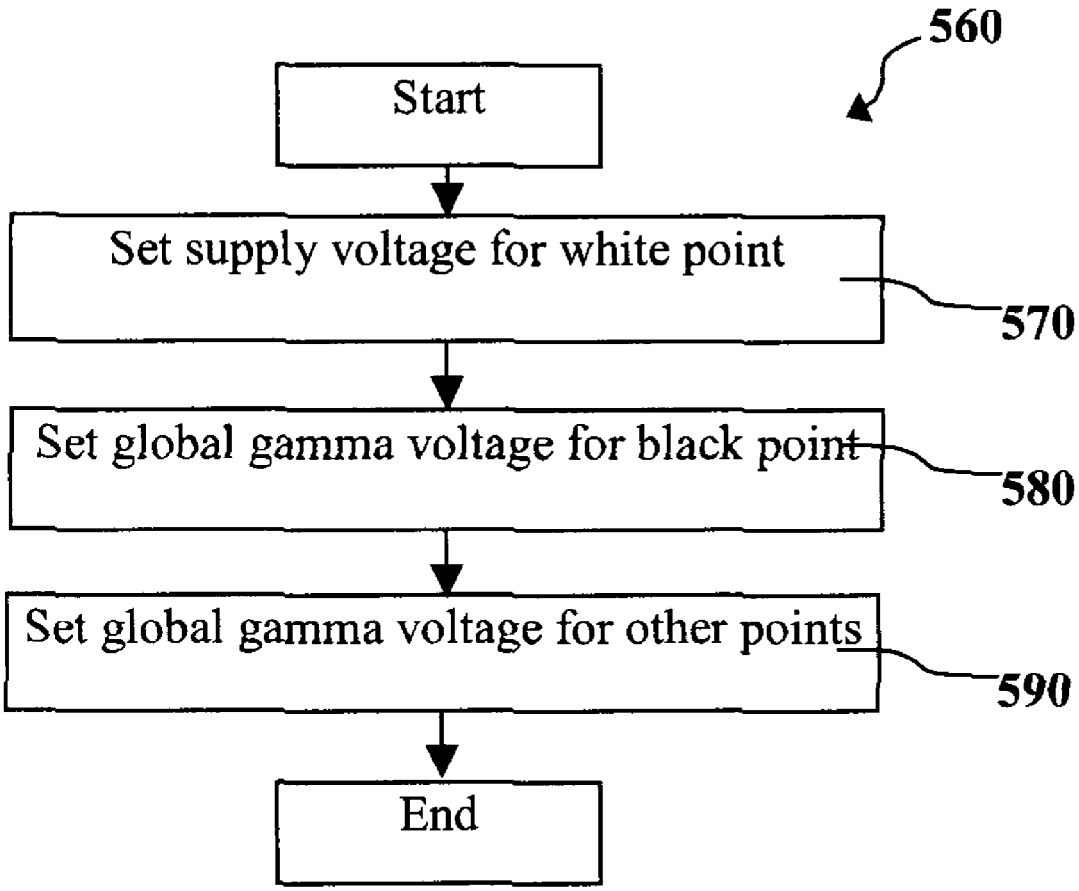
FIG. 12 is a block diagram showing the steps of preliminary adjustments via global adjustment controls in the practice of this invention.

Each code value is typically associated with a voltage used to drive the display to a particular luminance. It can be necessary to adjust the voltages associated with one or more of the code values. This can be accomplished in the case where a display has one or more global adjustment controls, which affect all channels. One would use the global adjustment controls to make preliminary adjustments to the display before using the method of this invention. That is, such a preliminary adjustment would be done before Step 100 of FIG. 3. Such global adjustment controls can include e.g. one or more supply voltages and, as taught e.g. by Park et al. in U.S. Pat. No. 6,806,853, one or more gamma voltages. FIG. 1 shows a graph of voltage vs. code value illustrating global adjustment for a display. Supply voltage 515 is e.g. the cathode voltage. In this example, desired display white point 510 is at an aim code value of 255, which has a data voltage associated with it. The difference between the data voltage and the supply voltage, which is called white point voltage 540, determines the luminance of the display at that code value. One can thus set supply voltage 515 so that the display produces the desired display white point when driven with the selected non-minimum code value set for which the desired display white point is achieved. This is Step 570 of method 560 in FIG. 12. It is desirable to set this point first because it determines the minimum voltage (and thus the power requirements) for the display to achieve the full desired dynamic range.

The desired display black point can then be adjusted. In this example, desired display black point 520 is at an aim code value of 0, which has a data voltage associated with it. The difference between the data voltage and the supply voltage, which is called black point voltage 550, determines the luminance of the display at that code value. The lowest of the global gamma voltages can be set so that the display produces the desired display black point when driven at the selected low level code values (Step 580 of FIG. 12).

Figure 11:
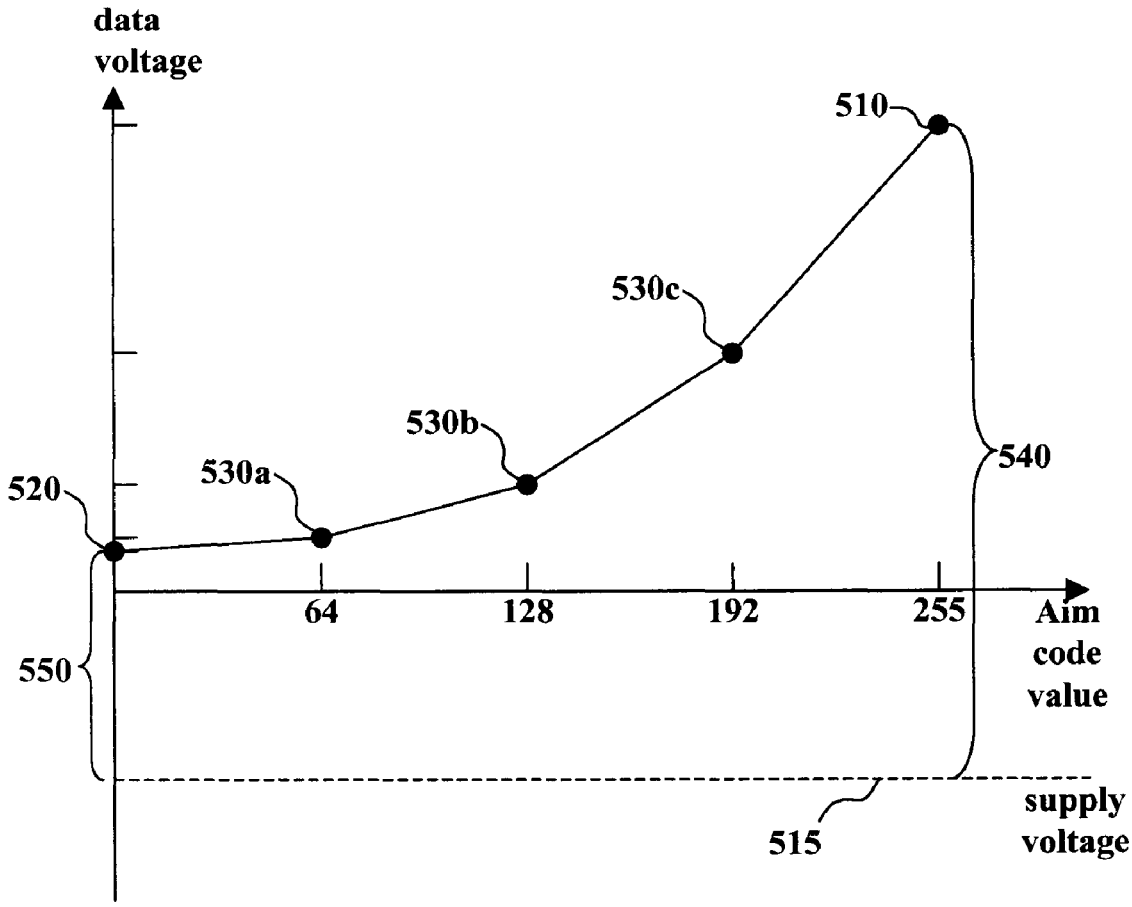
FIG. 11 shows a graph of voltage vs. code value illustrating global adjustment for a display.

There can be more global gamma voltages between the desired display white and black points, e.g. at display points 530*a*, 530*b*, and 530*c*. The global gamma voltages can be adjusted for each of these points (Step 590 of FIG. 12). For example, on display devices in which the luminance corresponding to a code value is linearly proportional to the difference between a reference voltage and the voltage corresponding to that code value, it can be useful to adjust these gamma voltages to produce a concave-up curve, such as that shown in FIG. 11. In it, the lower half of the code value range (0 to 127) encompasses a smaller subrange of the voltage range, and thus luminance range, than the subrange encompassed by the upper half of the code value range (128 to 255). The human eye is more sensitive to small changes in luminance at low luminance levels, and less sensitive to small changes at higher luminance levels. The curve in FIG. 11 assigns the lower half of the code values, for the lower luminance levels, to a much smaller subrange of the luminance range than the upper half of the code values. Thus, there is a finer resolution of the luminance range where the eye is more sensitive to small changes, and a coarser resolution where the eye is less sensitive to small changes: the luminance resolution corresponds to the eye's sensitivity.

Depending on the innate characteristics and drive electronics of a particular display device, gamma voltage curves may need different shapes to accomplish the desired effect of luminance resolution corresponding to eye sensitivity. For example, display devices such as OLEDs may be driven by current provided by drive transistors, and there is a nonlinear relationship between voltage on a drive transistor and current through the device. This nonlinearity can innately provide luminance resolution corresponding to eye sensitivity, so the gamma voltage curve can be linear. In other cases, achieving the desired display black point may require lower currents than the rest of the range would suggest, for example to place the drive transistor in its subthreshold operating region, so the gamma voltage curve can be concave down. In another example, conventional twisted-nematic LCDs as known in the art can have a variety of shapes of transmittance curve as a function of voltage; see for example Leenhouts in U.S. Pat. No. 4,896,947, FIG. 3; and Hatano in U.S. Pat. No. 5,155,608, FIG. 6*a*. In these cases, the gamma voltage curve can have as complex a shape as necessary to assign more code values to the low end of the transmittance range and fewer code values to the high end of the transmittance range, achieving the goal of having luminance resolution corresponding to eye sensitivity.

The invention has been described in detail with particular reference to certain preferred embodiments thereof, but it will be understood that variations and modifications can be effected within the spirit and scope of the invention.

PARTS LIST

| | |
|---|---|
| 20 | OLED device pixel |
| 30B | blue channel |
| 30G | green channel |
| 30R | red channel |
| 30W | further channel |
| 40 | computer |
| 42 | color display |
| 44 | sensor |
| 46 | light meter |
| 48 | analog/digital converter |
| 50 | display |
| 52 | target area |
| 54 | non-measurement area |
| 56 | measurement area |
| 60 | buck pattern |
| 62 | buck pattern |
| 70 | red channel |
| 72 | green channel |
| 74 | blue channel |
| 76 | within-gamut channel |
| 78 | desired display white point |
| 90 | method |
| 100 | step |
| 110 | step |
| 120 | step |
| 200 | step |
| 210 | step |
| 220 | step |
| 230 | step |
| 240 | step |
| 250 | step |
| 300 | step |
| 310 | step |
| 320 | step |
| 350 | step |
| 400 | step |
| 410 | step |
| 420 | step |
| 450 | step |
| 510 | desired display white point |
| 515 | supply voltage |
| 520 | desired display black point |
| 530a | display point |
| 530b | display point |
| 530c | display point |
| 540 | white point voltage |
| 550 | black point voltage |
| 560 | method |
| 570 | step |
| 580 | step |
| 590 | step |

What is claimed is:

1. A method for calibrating a display device having four or more channels, including three main channels which include in their gamut a desired display white point, and one or more further channels, said display device also having one or more individual adjustment controls for each channel, said method comprising the steps of:

a) displaying a first target using a low level code value for each channel of the display;

b) measuring and recording the luminance and chromaticity coordinates of the displayed first target;

c) displaying a second target using a minimum code value for each of the further channels, and a set of non-minimum code values, such set including one non-minimum code value for each of the three main channels;

d) measuring the luminance and chromaticity coordinates of the displayed second target;

e) adjusting the individual adjustment controls for each of the three main channels so that the chromaticity coordinates of the second target approximately match the chromaticity coordinates of the desired display white point;

f) recording the resulting values of the individual adjustment controls for each of the three main channels and the corresponding luminance and chromaticity coordinate measurements;

g) repeating steps c) through f) one or more times for each of a number of additional selected non-minimum code value sets;

h) displaying a third target using, for a first main channel, the value(s) of the individual adjustment control(s) for that channel recorded in step f) corresponding to a selected non-minimum code value set, and using, for each of the other channels, a minimum code value;

i) measuring and recording the luminance and chromaticity coordinates of the displayed third target;

j) repeating steps h) through i) for each remaining main channel;

k) displaying a fourth target using a selected code value for a first further channel, and a minimum code value for each of the other channels;

l) measuring and recording the luminance and chromaticity coordinates of the displayed fourth target;

m) repeating steps k) through l) for one or more of a number of additional selected code values of the first further channel; and n) repeating steps k) through m) for each remaining further channel, wherein the display device has global adjustment controls affecting all channels, further comprising the additional step, before step a), of making preliminary adjustments using the global adjustment controls.

2. The method of claim 1, wherein the low level code values and minimum code values used in steps a), c), h), and k) are all zero.

3. The method of claim 1, wherein the non-minimum code value set selected in step h) corresponds to the highest-luminance measurement recorded in step f).

4. The method of claim 1 wherein the same non-minimum code value set is selected in step h) for each main channel.

5. The method of claim 1 wherein the code value for a channel is also used as the individual adjustment control.

6. The method of claim 1, wherein for at least one target, a buck pattern is displayed on the display, said buck pattern comprising, across the at least one target, pixels driven with selected code values and pixels driven with relatively lower code values.

7. The method of claim 6, wherein the relatively lower code values are all zero.

8. The method of claim 1, wherein for at least one target, a boost pattern is displayed on the display, said boost pattern comprising a flat field driven with selected code values across the target area, and additional pixels outside the target area driven with higher code values.

9. The method of claim 8, additionally comprising selecting a display reference load condition; and wherein the at least one target for which a boost pattern is displayed is a relatively low luminance target, and displaying the boost pattern increases the display load when displaying that target so that the display load approximately matches the display reference load condition;

and further wherein for at least one different target at relatively high luminance, a buck pattern or a reduction pattern is displayed on the display to decrease the display load when displaying that target so that the display load approximately matches the display reference load condition, where said buck pattern comprises, across the at least one target, pixels driven with selected code values and pixels driven with relatively lower code values, and said reduction pattern comprises a flat field driven with selected code values across the target area, and additional pixels outside the target area driven with lower code values.

10. The method of claim 9, additionally comprising selecting a display reference temperature, and displaying all targets on the display so as to approximately match the display reference temperature.

11. The method of claim 1, additionally comprising selecting a display reference temperature, and displaying all targets on the display so as to approximately match the display reference temperature.

12. The method of claim 1, further comprising the step of using the measured data and individual adjustment control values for each channel to compute values used by an image-processing path to drive the display device.

13. The method of claim 1, wherein the three main channels are a red, a green, and a blue channel, and wherein at least one of the further channels is a color within the gamut formed by the red, green, and blue channels.

14. The method of claim 1, wherein at least one of the further channels is a broadband emitter.

15. The method of claim 1, wherein the color of at least one of the further channels varies with code value.

16. The method of claim 1, where a further channel has color that varies with code value, further comprising transforming three color-input signals (R, G, B) corresponding to three main channels of the display to four color-output signals (R', G', B', W) corresponding to the main channels and the further channel of the display, wherein said transforming comprises the further steps of:

o) determining a relationship, using the data collected in steps i) and l), between code value of the further channel and intensities of the three main channels which together produce equivalent color over a range of code values for the further channel; and p) employing the three color-input signals R, G, B and the relationship determined in step o) to determine a value W of the four color-output signals, and modification values to be applied to one or more of the R, G, B components of the three color-input signals to form the R', G', B' color-output signals.

17. The method of claim 16, further comprising driving the display with the four color-output signals or transformed values thereof, wherein the display comprises light-emitting elements that emit light corresponding to the main channels and the further channel.

18. The method of claim 16, wherein the R', G', and B' components of the four color-output signals are transformed to display code values.

19. The method of claim 16 wherein each of the three components of the (R,G,B) color-input signals is linear with respect to intensity.

20. The method of claim 16 wherein the R', G', B' values of the color-output signals are linear in intensity.

21. The method of claim 1, wherein the global adjustment controls comprise a supply voltage, and one or more global gamma voltages, and wherein the preliminary adjustments comprise the steps of:

setting the supply voltage so that the display produces a desired display white point when driven with a selected non-minimum code value set;

setting the lowest of the one or more global gamma voltages so that the display produces a desired display black point when driven with low level code values; and adjusting any remaining global gamma voltages to assign finer resolution to subranges of the luminance range of the display where the eye is more sensitive to small changes, and coarser resolution to subranges where the eye is less sensitive to small changes.

* * * * *